US005565662A

United States Patent [19]

Meyrat et al.

[11] Patent Number: 5,565,662

[45] Date of Patent: Oct. 15, 1996

[54] PUSH-BUTTON CONTACTOR

[75] Inventors: Clément Meyrat, Le Landeron; Olivier Sylvant, Sonceboz; Jean-Christophe Rothen, Bienne, all of Switzerland

[73] Assignee: SMH Management Services AG, Biel, Switzerland

[21] Appl. No.: 399,362

[22] Filed: Mar. 6, 1995

[30] Foreign Application Priority Data

Mar. 7, 1994 [CH] Switzerland ..... 00658/94

[51] Int. Cl.[6] ..... H01H 25/06

[52] U.S. Cl. ..... 200/4; 200/16 R; 200/275

[58] Field of Search ..... 200/4, 5 R, 5 A, 200/6 R, 11 R, 14, 11 A, 11 G, 11 H, 16 R–16 D, 18, 402, 405, 408, 409, 431, 434, 439, 442, 449, 451, 453, 458, 459, 502, 520, 522, 530, 531, 532, 534, 535, 536, 537, 564, 570, 571, 245, 246, 257, 275, 278, 283, 329, 336, 341

[56] References Cited

U.S. PATENT DOCUMENTS

| | | | |
|---|---|---|---|
| 3,243,528 | 3/1966 | Brady | 200/4 |
| 3,657,936 | 4/1972 | Judd | 74/128 |
| 4,031,341 | 6/1977 | Wuthrich et al. | 200/52 R |
| 4,088,854 | 5/1978 | Yajima | 200/6 R |
| 4,135,359 | 1/1979 | Yajima | 58/85.5 |
| 4,349,900 | 9/1982 | Aizawa | 368/187 |
| 4,808,129 | 2/1989 | Kershner | 439/856 |
| 4,866,219 | 9/1989 | Riding et al. | 200/4 |

FOREIGN PATENT DOCUMENTS

| | | | |
|---|---|---|---|
| 82382 | 9/1962 | France | H01H 1/26 |
| 1356966 | 1/1963 | France | H01H 1/26 |
| 2227616 | 11/1974 | France | H01H 13/50 |
| 642220 | 4/1984 | Switzerland | G04C 3/00 |

*Primary Examiner*—Brian W. Brown
*Assistant Examiner*—Michael A. Friedhofer
*Attorney, Agent, or Firm*—Sughrue, Mion, Zinn, Macpeak & Seas

[57] ABSTRACT

Control device for selectively closing electrical contacts situated on a plate (9), formed by a push-button (1) co-operating with a flat spring (3); the spring (3), fastened to a case (5) at one of its ends and attached to the push-button (1) at the other end, comprises strips (31, 32) formed by a series of loops (**31*i*, 32*i*) giving it elasticity along the axis of the stem (11), and flexible lamellar extensions (35, 36, 38) outside the plane of the spring (3), by the action of the lugs (20, 21, 22) of the stem (11**) when the push-button is moved in rotation and/or translation.

16 Claims, 4 Drawing Sheets

PUSH-BUTTON CONTACTOR

The present invention concerns a contactor device comprising a push-button and a flat spring, arranged in such a way that the spring constitutes both the elastic return means of the push-button and the means for closing electric contacts situated on a plate, the selection of said contacts being achieved by a translational or rotational movement of the push-button.

A device according to the invention finds its application in very varied fields, but it is particularly well suited to cases where a single control for several functions of a single apparatus is desired, for example, for ergonomic reasons as is the case in the instrument board of a locomotive engine, or for reasons of functional unity, as is the case in a timepiece, which will be used by way of illustrative example in the following description.

The push-buttons currently used to activate the different functions of a timepiece have the disadvantage of comprising elastic means of return to a neutral position generally distinct from means enabling the selective closure of the electric contacts, and the number of distinct pieces necessary for the construction of such push-buttons is generally high.

When a push-button comprises a single piece, constituting both the elastic return means and the contact means, the device has the disadvantage of only allowing a very limited number of different contacts, or even only a single contact. Push-buttons of the previous type are for example illustrated in the patents mentioned below.

Patent CH 604 857 discloses an electrical push-button switch in which the elastic return means is a conductive elastomer conductor which also constitutes the contact means, but only allows a single contact to be closed when the push-button is pressed in.

Patent CH 621 034 discloses a mechanism in which a first strip-spring enables the push-button to occupy a neutral position, then two other positions in which it acts upon a second strip either to release it from a constraint or to flex it, thus allowing it to establish only two contacts.

In patent EP 0 240 778 a push-button mechanism is achieved by means of a flat metallic spring whose complex cut is designed in such a way that one of its arms can close an electric contact, but only one.

An aim of the present invention is thus to overcome the disadvantages of the aforementioned prior art and to provide a push-button which is simple to make and inexpensive due to the fact that it comprises a reduced number of pieces, whilst enabling several contacts situated on a plate to be closed selectively.

The push-button according to the invention is thus made up of two pieces, a button extended by a stem and a flat spring, one end of Which is attached to the button and the other end of which is fixed onto a stud holding a plate carrying the contacts, said plate also being able to carry a printed circuit. The flat spring is characterised in that it is shaped so as to have, on the one hand elasticity along an axis parallel to the axis of the stem in order to bring the push-button back into a neutral position, and on the other hand, flexibility outside a plane parallel to the axis of the stem.

In order to have elasticity along the axis of the stem, the spring is formed of one or more strips having a series of loops in a general direction parallel to the axis of the stem. In order to have flexibility outside a plane parallel to the axis of the stem, the spring has flexible lamellar extensions in directions substantially perpendicular or parallel to the axis of the stem. These flexible lamellar extensions are formed of one or two arms intended to cooperate with lugs situated on the push-button stem, when the latter is driven in rotation or in translation. It is also possible to provide at least one lamellar extension with a permanent deformation outside the plane of the spring so as to establish a sliding contact on the plate when the push-button is driven in translation. The spring of the device according to the invention may be obtained very simply by stamping a sheet in a flexible material. The flexible material used may be metal, for example a steel alloy with a strong modulus of elasticity such as Durimph®. In the case where a non conducting flexible material is used, the ends of the lamellar extensions include a conducting coating.

When a push-button according to the invention is used in a timepiece, it enables for example the time to be adjusted and an alarm time to be stored. Used in an instrument board, it enables for example the daily kilometre counter to be reset to zero and the board clock to be adjusted.

The push-button itself may be obtained economically in a single piece by moulding a plastic material. In addition to the lugs and means of fastening the spring, it may comprise means enabling its rotational and/or translational movement to be limited.

The invention will be better understood with reference to the embodiment examples shown in the attached drawings in which.

Figure 1:
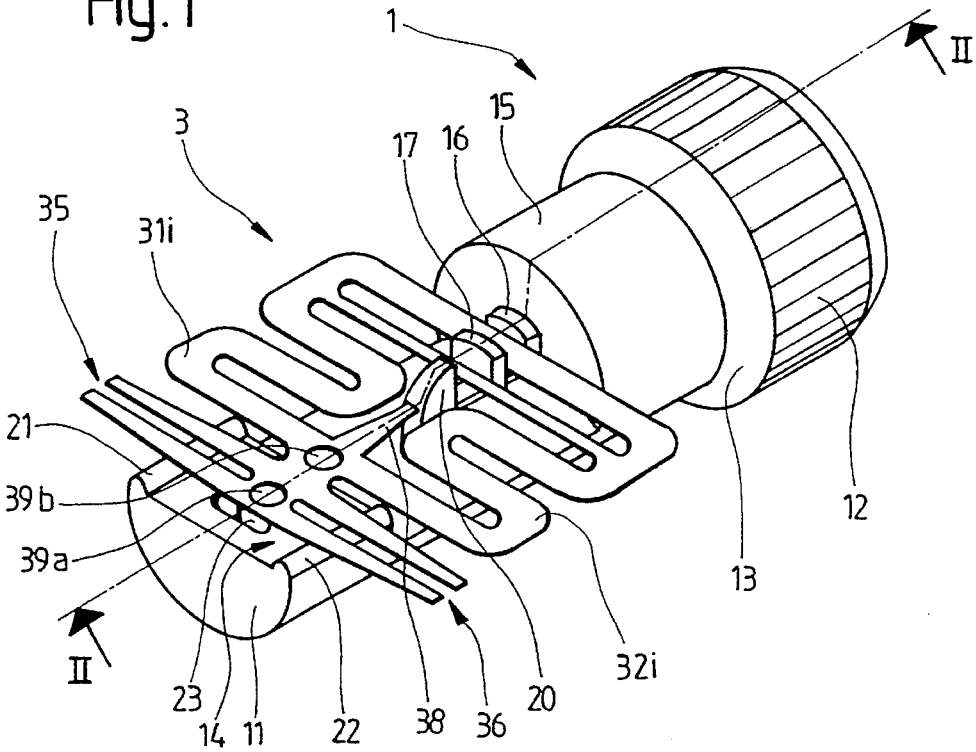
FIG. 1 shows a perspective view of a push-button according to the invention, provided with a flat spring.
Figure 2:
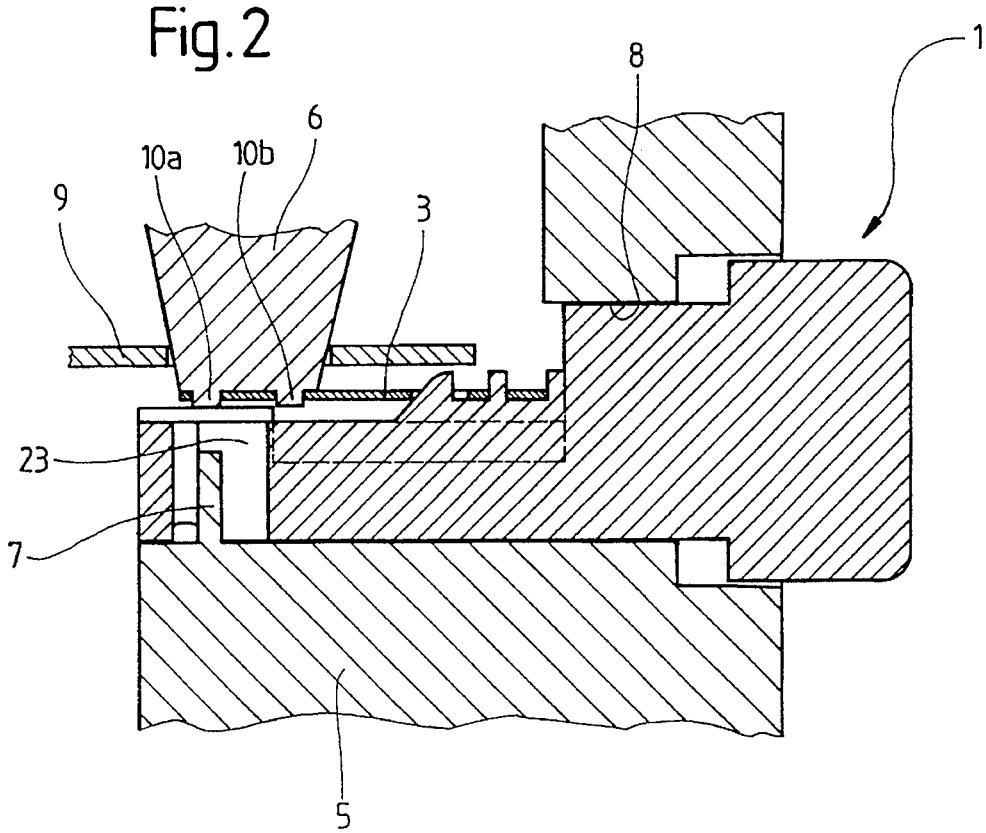
FIG. 2 is a cross-sectional view of the push-button of FIG. 1, assembled in a case comprising a contact plate.

FIG. 1 is a perspective view of push-button 1 on which is mounted a flat spring 3, and FIG. 2 is a cross-sectional view of push-button 1 and of flat spring 3 used with it, positioned in a case 5 comprising a guiding recess 8. In the neutral position shown in FIG. 2 flat spring 3 is parallel to a plate 9, carrying electrical contacts. Plate 9 is held by a stud 6 attached to case 5, said stud comprising fastening points 10*a* and 10*b* intended to fasten spring 3 across drilled holes 39*a* and 39*b* situated at one of its ends.

Figure 3:
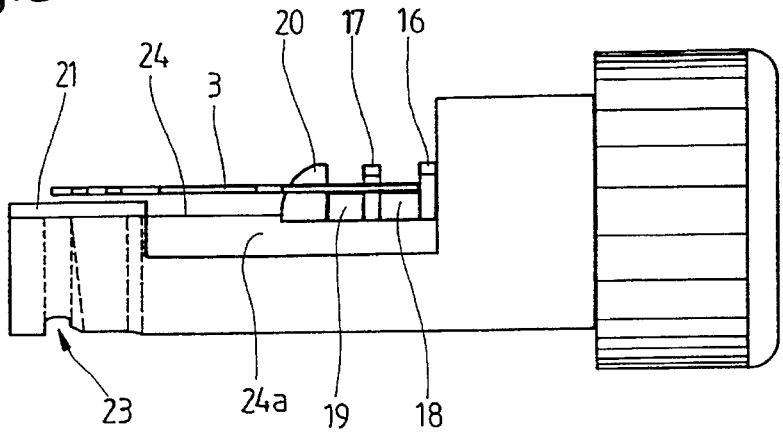
FIG. 3 is a side view of the push-button of FIG. 1.
Figure 4:
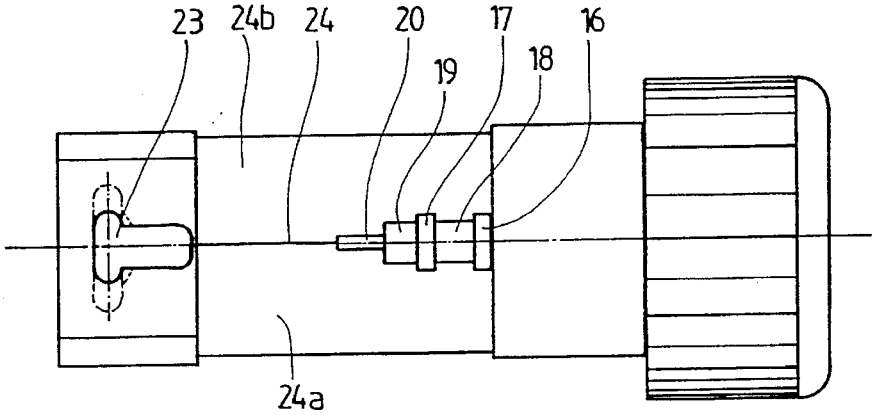
FIG. 4 is a top view of the push-button of FIG. 1, without the flat spring.

Push-button 1 comprises a stem 11 of a generally cylindrical shape and a crown 12 delimiting, with stem 11, a flange 13. Stem 11 comprises a substantially flat zone 14 delimiting a sleeve 15 against flange 13 and a sector comprising positioning clips 16, 17 of spring 3 and lugs 20, 21, 22. Small bearings 18, 19 visible in FIGS. 3 and 4, are provided between clips 16 and 17, and between clip 17 and lug 20, to maintain a small space between spring 13 and zone 14. Lug 20 is positioned in the axis of the push-button in order to co-operate with spring 3 in the translational movements. Lugs 21 and 22 are positioned symmetrically in relation to the axis of the push-button in order to co-operate with spring 3 in the rotational movements. Referring in particular to FIGS. 3 and 4, one can see that the end of stem 11 comprises a guiding recess 23, formed in a T to limit the rotational and/or translational movements of the push-button by co-operation with a guiding component, formed by a post 7 attached to case 5, as is shown in FIG. 2. Guidance component 7 could equally be carried by stud 6 attached to the case and carrying contact plate 9. In the embodiment shown, the surface 14 carrying clips 16, 17 and lugs 20, 21 and 22 comprises two chamfered edges 24*a*, 24*b* on either side of a central edge 24, so that the parts of the spring ensuring longitudinal elasticity are not depressed when the push-button is rotated.

Figure 5:
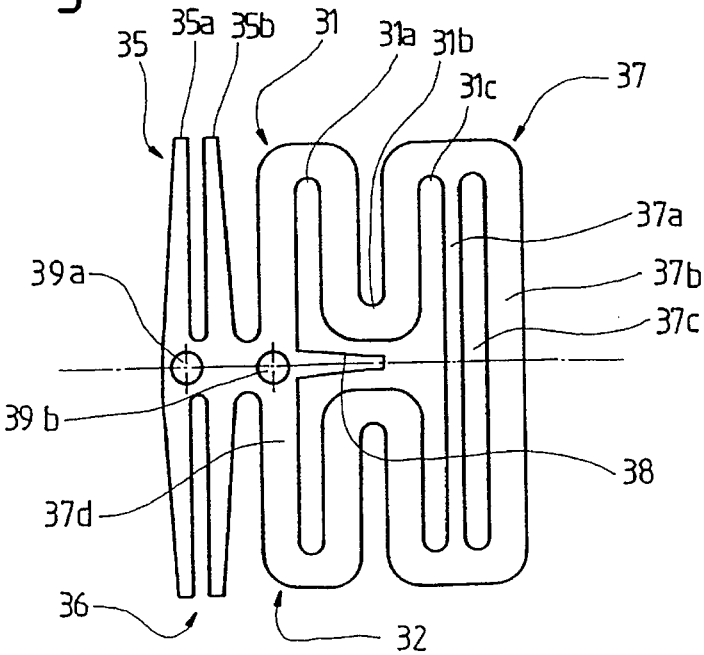
FIG. 5 is a top view of the push-button of the flat spring of FIG. 1.

Referring now more particularly to FIG. 5, it can be seen that the spring, corresponding to the embodiment of FIGS. 1 to 4, has an axial symmetry and that it comprises on either side of the axis, a strip 31 (respectively 32), formed of a series of loops open alternately towards the interior 31*a*, 31*c* and to the exterior 31*b*, more generally designated by 31*i* (respectively 32*i*), a lamellar extension 35 (respectively 36), perpendicular to the axis and formed of two arms 35*a*, 35*b*, and a stiffening and fixing zone 37 made up of two bands 37*a*, 37*b* perpendicular to the axis and intended to come to press against the bearings 18, 19 of the push-button, these two bands delimiting an opening 37*c* intended to receive clip 17 to keep spring 3 attached to the push-button in translation, whilst leaving it free in rotation. In the axis of the spring, and on a band 37*d*, perpendicular to the axis and closing strips 31, 32 is a lamellar extension 38, intended to co-operate with lug 20 of the push-button. The spring further comprises, at its position opposite to the one where it is fixed to the push-button drilled holes 39*a*, 39*b*, intended to fix it onto a stud 6 attached to case 5, as shown in the schematical cross-section of the assembly of FIG. 2. In this drawing, plate 9 has also been shown, comprising contacts which are selectively closed by lamellar extension 38 when the push-button is pressed in, or by one or other of lamellar extensions 35, 36 when the push-button is rotated.

Figure 6:
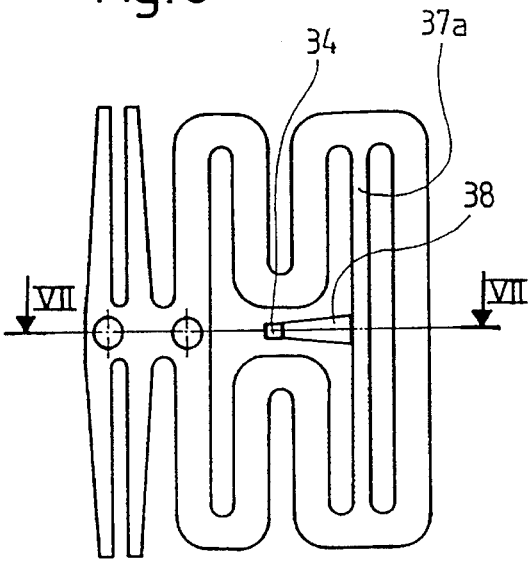
FIGS. 6 to 10 show other embodiments of a flat spring, able to be used in a push-button device according to the invention.
Figure 7:
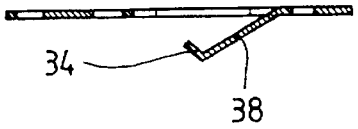

The spring which has just been described in the above-mentioned device may have numerous other forms without departing from the framework of the invention. FIG. 6 shows a spring substantially identical to that of FIG. 5, but in which lamellar extension 38 is attached to band 37*a* and has a permanent deformation outside the general plane of the spring so as to ensure a sliding contact on plate 9. FIG. 7, which is a cross-sectional view along the line VII—VII of FIG. 6, shows an embodiment of the deformation of lamellar extension 38 whose end 34 is bent back towards the plane of the spring. The push-button used with such a spring obviously has no central lug 20.

Figure 8:
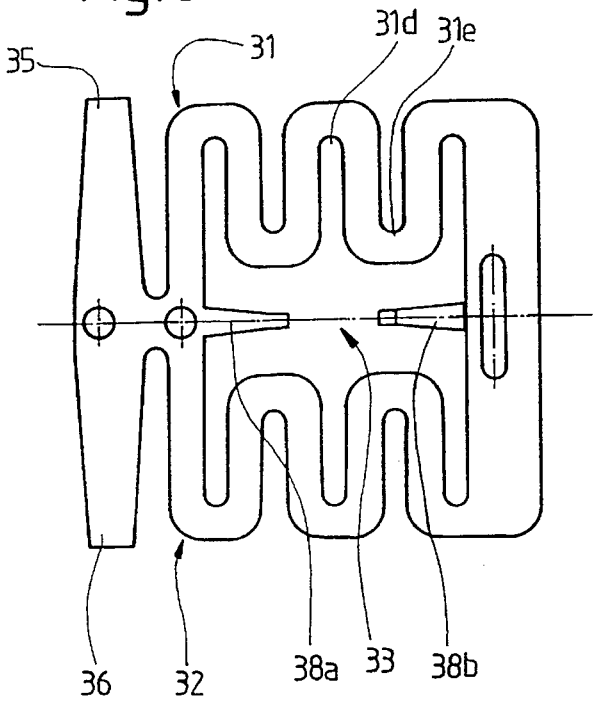

FIG. 8 shows another embodiment in which strip 31 comprises two additional complementary loops 31*d*, 31*e*, the space 33 free between the two strips 31, 32 allowing at the same time, a contact by flexing lamellar extension 38*a* when the button is pressed in, a sliding contact 38*b* when it is pulled out, and two contacts by lamellar extensions 35, 36 when it is rotated in one direction or the other from its rest position. It will also be noted that lamellar extensions 35, 36 are not divided into two arms, which corresponds to a preferred embodiment when the flexible material forming the spring is not a conductor, the ends of the lamellar extensions including in such case a conducting coating.

Figure 9:
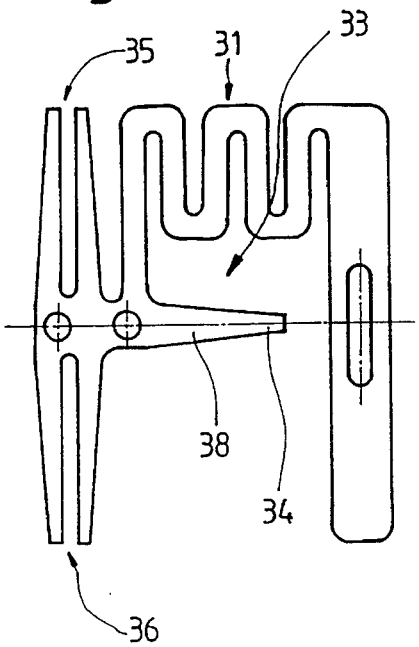

FIG. 9 shows a fourth embodiment of a spring comprising only one strip 31 and having a lamellar extension 38 extending, in the axis of central recess 33, the part comprising the other lamellar extensions 35, 36, by such a length that its end 34 is already slightly flexed by lug 20 towards plate 9 carrying the contacts when the push-button is in a neutral position. It will also be noted that, in this embodiment, lamellar extension 38 also contributes to the reinforcement of the elasticity of the spring along the axis of the push-button.

Figure 10:
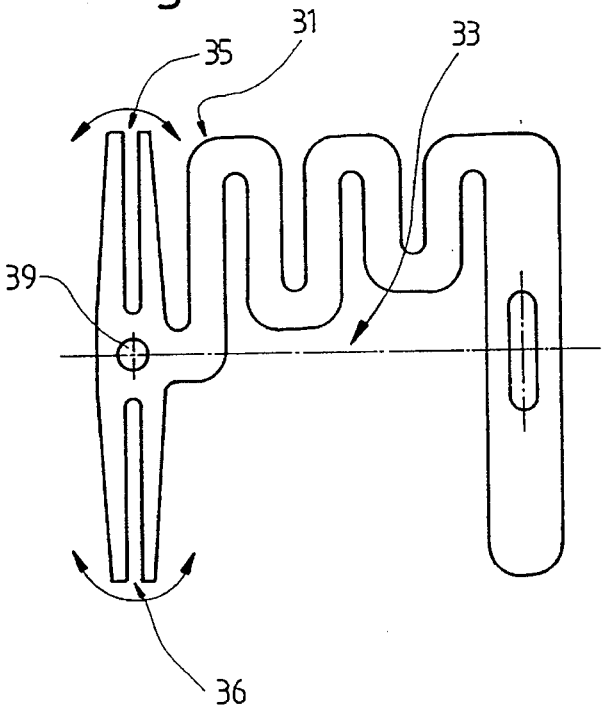

FIG. 10 shows a fifth embodiment in which the spring only has a single strip whose loops turned towards the exterior, become increasingly deeper from the fastening to the push-button until the fastening 39 to the case, said fastening 39 constituting an axis of rotation around which each lamellar extension 35, 36 can occupy, above plate 9, three positions according to whether the push-button is in the neutral, pulled out or pushed in position, which thus enables six different contacts to be established by rotating crown 12 in one direction or the other.

Figure 11:
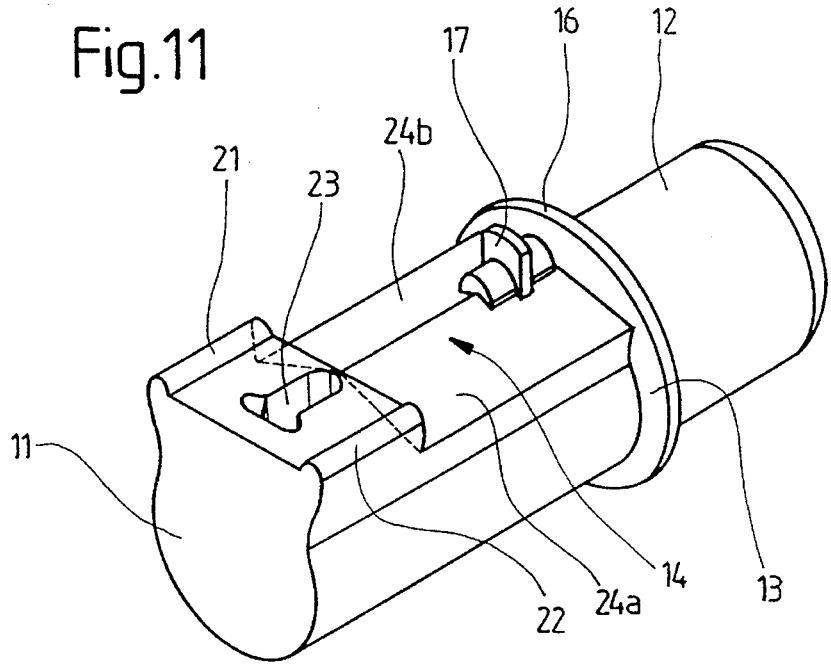
FIGS. 11 to 13 show other embodiments of the body of the push-button.
Figure 12:
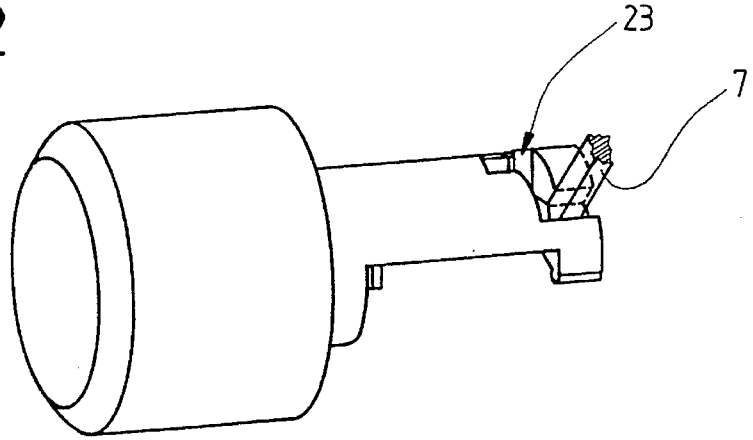

FIGS. 11 and 12 show other embodiments of the body of the push-button. In the embodiment shown in FIG. 11, zone 14 carrying lugs 21, 22 and clip 17 is situated entirely above stem 11, one end of which forms crown 12, flange 13 being thus formed by a circular extension of clip 16, the rear face of said flange 13 being provided to come to press against the internal face of case 5.

Figure 13:
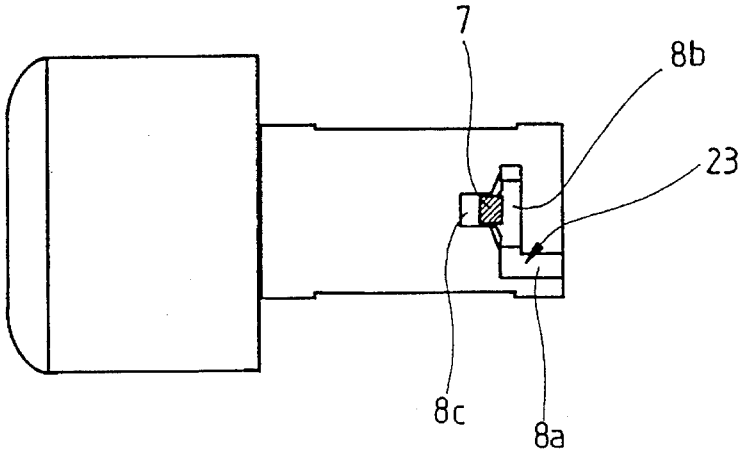

FIGS. 12 and 13 show, respectively in a perspective view and a top view of FIG. 12, another embodiment of guiding recess 23, which enables, once spring 3 is attached to stud 6 by its attachment points 39*a*, 39*b*, the push-button to be put into place from outside case 5. FIG. 12 shows more accurately the position of guiding component 7 when it is inserted in a first groove 8*a* parallel to the axis, open at one end of the stem and forming with the median plane of the push-button an angle sufficient to ensure that the end of clip 17 is level with the slot 37*c* of spring 3. The other end of groove 8*a* opens out into another groove 8*b* perpendicular to the axis and communicating in its middle, in the median plane of the push-button, with a third groove 8*c* parallel to the axis of the push-button. FIG. 13 shows the position of the guiding component 7 in the neutral position.

Without departing from the framework of the invention, a man skilled in the art will be able, in light of the description which has just been given, to provide appropriate modifications to the body of the push-button and to that of the spring to adapt it to the particular type of equipment in which such a device is required to be used.

What is claimed is:

1. A control device for selectively closing several electrical contacts situated on a plate attached to a case by a stud, said device comprising:

a push-button having a stem which extends into the case along an axis of the stem; and a spring which has an axis, which is situated in a plane, and which is made of an elastic material, said plane and said axis of the spring being parallel to the axis of the stem, wherein said spring comprises at least one strip having a series of loops giving the spring elasticity along the axis of the spring, and flexible lamellar extensions outside the plane of the spring, said strip connecting the spring between one end of the stem and the stud attached to the case, said lamellar extensions having ends for contacting the electrical contacts, and wherein said stem comprises lugs cooperating with the lamellar extensions to close one of the electrical contacts situated on the plate when the push-button is driven with a movement selected from a group consisting of rotational and translational movement.

2. The control device according to claim 1, wherein the spring comprises a second strip, each of said one and second strips having a series of loops symmetrical to the axis of the stem.

3. The control device according to claim 1, wherein the spring comprises only a single strip in the form of said one strip, thereby leaving free a space situated in the axis of the stem.

4. The control device according to claim 1, wherein the loops of said strip have openings of equal depths.

5. The control device according to claim 1, wherein the loops of said strip have openings of unequal depths.

6. The control device according to claim 1, wherein the lamellar extensions are perpendicular to the axis of the spring.

7. The control device according to claim 6, wherein the lamellar extensions are situated on a portion of the spring attached to the case.

8. The control device according to claim 1, wherein one of the lamellar extensions is parallel to the axis of the spring.

9. The control device according to claim 8, wherein the lamellar extensions are bent back outside the plane of the spring.

10. The control device according to claim 1, wherein at least one of the lamellar extensions is formed of two adjacent arms.

11. The control device according to claim 1, wherein the elastic material forming the spring is a steel alloy having great elasticity.

12. The control device according to claim 1, wherein the spring is a non conducting elastic material, and the ends of the lamellar extensions are covered with a conducting coating.

13. The control device according to claim 1, wherein the stem comprises a substantially semicylindrical section portion, a flat part of which is provided on its outermost edges with said lugs flexing the lamellar extensions perpendicular to the axis of the spring when the push-button is driven in rotation.

14. The control device according to claim 1, wherein the stem comprises a substantially cylindrical section portion having a flat part comprising in its substantially central part at least one of said lugs which flexes at least one of the lamellar extensions parallel to the axis of the spring when the push-button is driven in translation.

15. The control device according to claim 1, wherein the stem also comprises a guiding recess which cooperates with a post attached to the case to limit the rotational or translational movement of the push-button to two extreme positions, on either side of a neutral position in which no contact is closed.

16. The control device according to claim 1, wherein the spring is fixed to the push-button by means of an opening in which a clip is inserted carried by the stem.

* * * * *